US005735159A

United States Patent [19]

Schiavi

[11] Patent Number: 5,735,159

[45] Date of Patent: Apr. 7, 1998

[54] ASSEMBLY TO EXPEL BARS

[75] Inventor: Davinci Schiavi, Udine, Italy

[73] Assignee: Danieli Centro Maskin SpA, Pradamano, Italy

[21] Appl. No.: 698,849

[22] Filed: Aug. 16, 1996

[30] Foreign Application Priority Data

Aug. 31, 1995 [IT] Italy ..... UD95A0167

[51] Int. Cl.[6] ..... B21C 1/32

[52] U.S. Cl. ..... 72/275; 72/291; 72/427

[58] Field of Search ..... 72/275, 274, 291, 72/427, 164, 160

[56] References Cited

U.S. PATENT DOCUMENTS

| | | | |
|---|---|---|---|
| 3,250,362 | 5/1966 | Mitchell | 72/291 |
| 3,251,212 | 5/1966 | Morgan | 72/427 |
| 3,258,951 | 7/1966 | Kinnicutt | 72/427 |
| 4,663,955 | 5/1987 | Redman | 72/160 |

FOREIGN PATENT DOCUMENTS

| | | | |
|---|---|---|---|
| 383756 | 8/1987 | Austria . | |
| 0559586 | 9/1993 | European Pat. Off. . | |
| 1164727 | 10/1958 | France | 72/274 |
| 523731 | 6/1972 | Switzerland . | |
| 325069 | 1/1972 | U.S.S.R. | 72/274 |

*Primary Examiner*—Daniel C. Crane

*Attorney, Agent, or Firm*—Antonelli, Terry, Stout, & Kraus, LLP

[57] ABSTRACT

Assembly to expel bars which is associated with a bar production line (11) fed by a coiled roll (12), the bar production line (11) comprising in line a straightening and drawing assembly (13), an assembly (14) for shearing to size, a revolver-type storage assembly (15) and a gauging assembly (16), the revolver-type storage assembly (15) comprising rotary drum means (17) including peripherally a plurality of container seatings (18) to hold the drawn bars, the assembly to expel bars (10) comprising thrust means (21) associated with guide means (26) cooperating with the container seating (18) lying momentarily on the same axis as the axis (20) of the bar production line (11).

4 Claims, 2 Drawing Sheets

ASSEMBLY TO EXPEL BARS

BACKGROUND OF THE INVENTION

This invention concerns an assembly to expel bars.

The bar expulsion assembly according to the invention is applied to the field of production of bars and, to be more exact, to a drawing line downstream of shearing means associated with the drawing and straightening assembly and upstream of the revolver-type storage assembly associated with the pair of gauging rolls located downstream.

The bar expulsion assembly according to the invention makes it possible, in an extremely easy and quick way, to free the revolver-type storage assembly, or other type of passive conveying system, of the last bars contained in their seatings.

Plants to produce bars fed from a coiled roll normally comprise a first straightening and drawing assembly followed by a storage assembly, typically of the revolver-type.

Between these two assemblies are installed shears to shear to size the straightened and drawn bar.

The revolver-type storage assembly includes a rotary drum having in its periphery a plurality of symmetrically arranged container seatings, normally parallel to each other, each of which is suitable to hold a bar.

The revolver-type storage assembly has the task of creating a buffer stock of bars to be subjected to the next step of gauging carried out by the gauging assembly located downstream.

This revolver-type storage assembly is fitted with its axis parallel to, but offset from, the drawing axis so as always to include a container seating on the same axis as the drawing axis.

The bar held in the container seating of the revolver-type storage assembly which finds itself inside the seating which is momentarily on the same axis as the drawing axis is thrust by the new bar being fed by the straightening and drawing assembly.

The previous bar is thrust towards the outside of the container seating of the revolver-type storage assembly until it reaches the position in which it is engaged by the pair of gauging rolls positioned downstream, and thus the relative container seating in the revolver-type storage assembly is freed, to be filled again by the new bar.

This operation is performed until the coiled feeder roll has been fully used up or until it is decided to change that feeder roll.

In order to feed the last bars still associated with the various container seatings of the revolver-type storage assembly, the machine operators now have to perform manual operations and to thrust the relative bars with makeshift means or equipment not specifically intended for that purpose until the leading end of the relative bar juts out enough from the relative container seating to cooperate with the pair of gauging rolls.

This operation is not very practical, it is dangerous and reduces considerably the output of the whole production line.

Moreover, this operation requires the presence of at least one machine operator for its performance.

SUMMARY OF THE INVENTION

The present applicants have designed, tested and embodied this invention to overcome the shortcomings of the state of the art and to achieve further advantages.

The purpose of the invention is to provide an assembly to expel bars which is associated with a bar production line fed by a coiled roll and which is simple and practical and allows the automatic expulsion of the last bars held in the container seatings of the revolver-type storage assembly associated with the bar production line.

The expulsion assembly according to the invention is associated with the revolver-type storage assembly and comprises thrust means which can be actuated momentarily.

These thrust means have a first inactive position and a second working position in which they cooperate with the container seating of the revolver storage assembly which is coaxial with the drawing axis, inside which container seating the bar to be expelled is contained.

The thrust means are actuated so as to thrust the bar held in that container seating so far as to make it protrude from the seating by a segment long enough to make the leading end of the bar cooperate with the pair of gauging rolls positioned downstream or with other means positioned downstream.

The thrust means may be of a bar type when they are working only axially.

According to a variant the thrust means consist of actuator means.

According to another variant the thrust means are embodied with a resilient element able to follow a curved path and at the same time able to withstand axial thrusts, as for instance when a resilient tubular element is employed which consists of loops of piano wire tightly wound together.

This embodiment has the double advantage of keeping the thrust means near the revolver-type storage assembly even in the rest position, thus reducing the working cycle times, and also of limiting the total bulk space taken up by the expulsion assembly.

When the bar has been expelled from the revolver storage assembly, the thrust means are brought back to their inactive position and are freed from the container seating.

This operation is then advantageously repeated for all the last bars present in the container seatings of the revolver-type storage assembly, by means of the correct positioning of the revolver-type storage assembly.

This operation can be automated advantageously by associating a control and actuation assembly with the expulsion assembly according to the invention and with the revolver storage assembly.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 4:
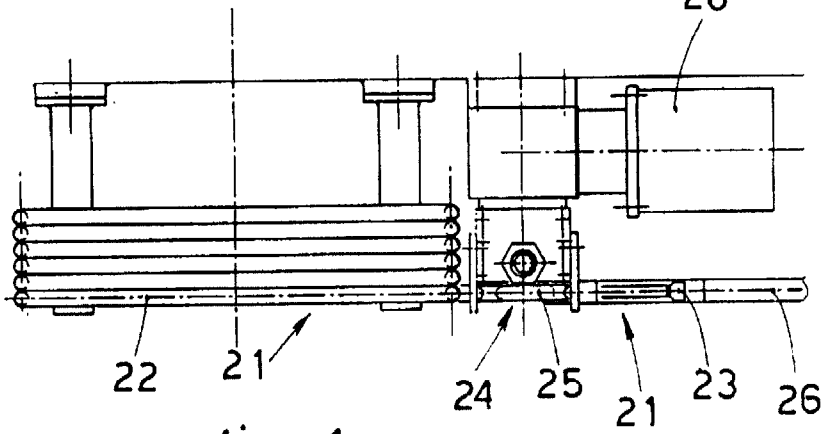
FIG. 4 is a plan view of the assembly to expel bars according to the arrow B of FIG. 2.
Figure 1:
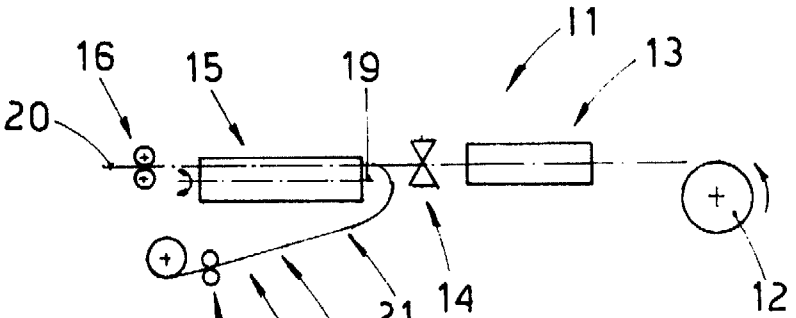
FIG. 1 is a diagram of a line to produce bars from a coiled roll, the line comprising the assembly to expel bars according to the invention.
Figure 3:
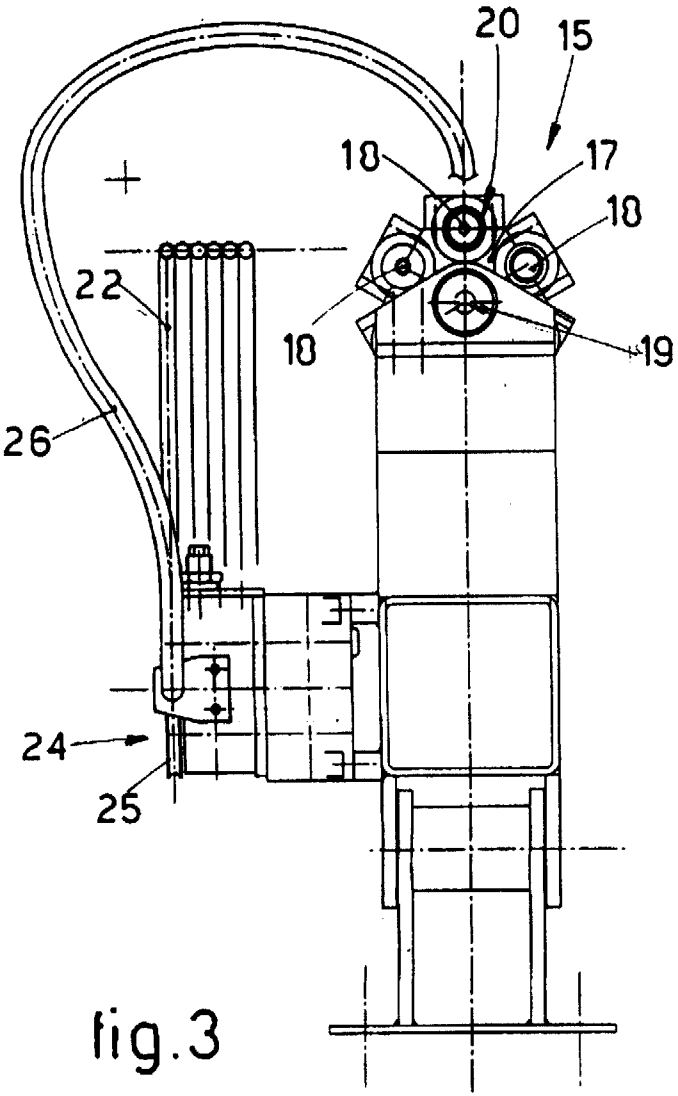
FIG. 3 is a front view of the assembly to expel bars along the line A of FIG. 2.
Figure 2:
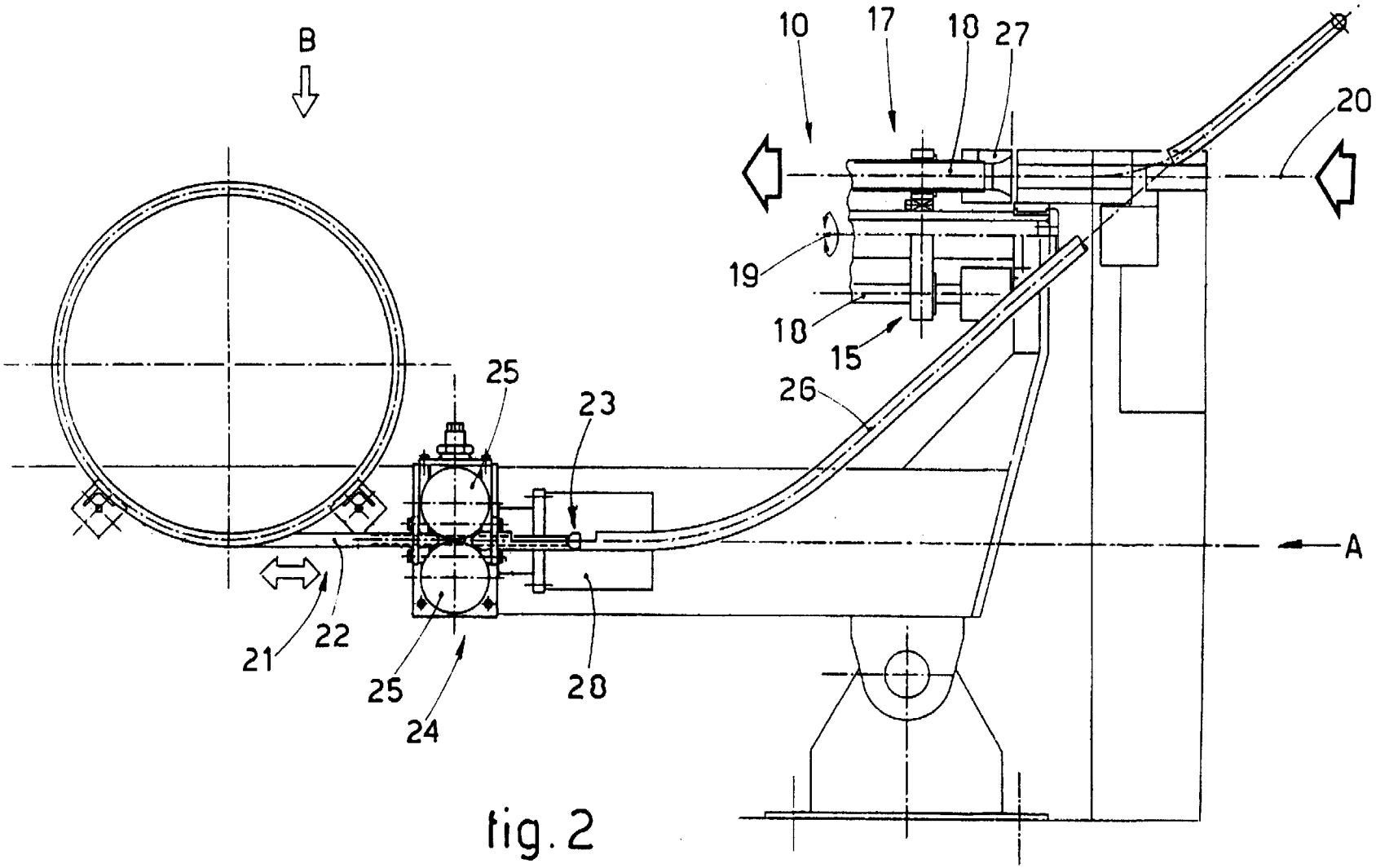
FIG. 2 is a side view of the assembly to expel bars according to the invention.

The reference number 10 in the attached figures denotes generally an assembly to expel bars according to the invention The assembly 10 to expel bars according to the invention is applied to a bar production line 11 fed from a coiled roll 12, the line 11 comprising in series a straightening and drawing assembly 13, an assembly 14 for shearing to size, a revolver storage assembly 15 and a gauging assembly 16.

The revolver storage assembly 15 is of a known type and comprises a drum 17 including in its periphery a plurality of container seatings 18 and fitted so as to be able to rotate about an axis 19, which is parallel to, but offset from, the processing axis 20 of the bar production line 11.

In this case the drum 17 includes six symmetrically arranged container seatings 18, which are positioned in turn on the same axis as the processing axis 20 of the bar production line 11.

The assembly 10 to expel bars according to the invention comprises thrust means 21 consisting in this case of a resilient tubular element 22, which has at its leading end a thrust head 23.

This resilient tubular element 22 may consist advantageously of loops of piano wire tightly wound together and able to follow a curved path and to withstand axial thrusts at the same time.

So as to limit the overall bulk when in its inactive position, the resilient tubular element 22 is coiled in spirals at the side of the revolver storage assembly 15.

The resilient tubular element 22 cooperates with a feeding/withdrawing assembly 24, consisting in this case of two opposed rolls 25 associated with a motor 28 so as to cause the resilient tubular element 22 and therefore the thrust head 23 to be fed forwards/retracted backwards.

In this case, the assembly to expel bars 10 according to the invention comprises a suitably shaped curved guide conduit 26 able, in this case, to form a loop; when the number of the bars which remain to be fed by the coiled roll 12 is equal to the number of the container seatings 18 of the revolver-type storage assembly 15, the resilient tubular element 22 is inserted into the conduit 26 so as to be brought onto the same axis as the intake 27 of the container seating 18 lying momentarily on the same axis as the axis 20 of the bar production line 11.

The resilient tubular element 22 is then introduced inside the container seating 18 where there is the bar which is to be expelled, pushing it from behind in order to make it protrude at the front until it reaches a position in which its leading end is in the gripping area of the gauging rolls 16 placed downstream.

At this point, the resilient tubular element 22 is withdrawn, the revolver-type storage assembly 15 turns to bring a new container seating 18 to face the guide conduit 26, and therefore on the axis of the gauging rolls 16, and the operation of expulsion is repeated until the whole revolver-type storage assembly has been emptied of the bars.

According to a variant which is not shown here, the thrust means 21 are of an axial type and comprise a bar element or else piston means positioned at least momentarily on the same axis as the processing axis 20 of the bar production line 11.

I claim:

1. A bar production line having a longitudinal feed axis, comprising:

a straightening and drawing assembly for straightening and drawing bar fed along the longitudinal feed axis from a coiled roll;

a shearing assembly provided downstream of the straightening and drawing assembly for shearing to size bar fed along the longitudinal feed axis downstream of the straightening and drawing assembly;

a revolver-type storage assembly provided downstream of the shearing assembly and comprising a rotary drum having a plurality of container seatings provided around a periphery thereof to hold drawn and sheared to size bars, each container seating having an intake through which a drawn and sheared to size bar enters the container seating, the rotary drum being rotatable about an axis parallel to the longitudinal feed axis to align one of the container seatings with the longitudinal feed axis;

a gauging assembly provided along the longitudinal feed axis downstream of the revolver-type storage assembly; and a bar expulsion assembly comprising a guide having one end cooperating with the intake of the container seating lying momentarily on the longitudinal feed axis, and a thrust element having a first resting position offset from the longitudinal feed axis and a second working position in cooperation with the guide and the intake of the container seating momentarily lying on the longitudinal feed axis for expelling the bar provided in the container seating momentarily lying on the longitudinal feed axis.

2. A bar production line as in claim 1, in which the first resting position is located in proximity of and beside the revolver-type storage assembly.

3. A bar production line as in claim 1, in which the thrust element comprises a resilient tubular element having at its leading end a thrust head and wherein the bar expulsion assembly further comprises a two-way feeding/retracting assembly for feeding and retracting the tubular element through or from the guide.

4. A bar production line as in claim 3, in which the resilient tubular element in the inactive position is conformed with piano wire tightly wound in a spiral.

* * * * *